US008518191B2

(12) United States Patent
Han

(10) Patent No.: US 8,518,191 B2
(45) Date of Patent: Aug. 27, 2013

(54) BAKE-HARDENABLE COLD ROLLED STEEL SHEET WITH SUPERIOR STRENGTH, GALVANNEALED STEEL SHEET USING THE COLD ROLLED STEEL AND METHOD FOR MANUFACTURING THE COLD ROLLED STEEL SHEET

(75) Inventor: Seong-Ho Han, Gwangyang (KR)

(73) Assignee: POSCO, Pohang (KR)

( * ) Notice: Subject to any disclaimer, the term of this patent is extended or adjusted under 35 U.S.C. 154(b) by 0 days.

(21) Appl. No.: 13/360,632

(22) Filed: Jan. 27, 2012

(65) Prior Publication Data

US 2012/0138198 A1 Jun. 7, 2012

Related U.S. Application Data

(62) Division of application No. 12/067,764, filed as application No. PCT/KR2006/003778 on Sep. 22, 2006, now Pat. No. 8,128,763.

(30) Foreign Application Priority Data

Sep. 23, 2005 (KR) ..... 10-2005-0088517
Aug. 25, 2006 (KR) ..... 10-2006-0081042

(51) Int. Cl.
*C22C 38/14* (2006.01)
*C22C 38/04* (2006.01)
*C21D 8/02* (2006.01)

(52) U.S. Cl.
USPC ..... 148/330; 148/320; 148/603; 148/533; 148/659; 420/87; 420/126; 420/128; 428/659

(58) Field of Classification Search
USPC ..... 148/320, 330, 603, 533; 420/87, 420/126, 128; 428/659
See application file for complete search history.

(56) References Cited

U.S. PATENT DOCUMENTS 5,556,485 A 9/1996 Taylor et al.
5,656,102 A 8/1997 Taylor et al.

(Continued)

FOREIGN PATENT DOCUMENTS

JP 57-089437 6/1982
JP 61-026757 2/1986

(Continued)

OTHER PUBLICATIONS

Machine-English translation of Japanese patent No. 05-171353, Furuno Yoshikuni, Jul. 9, 1993.*

(Continued)

*Primary Examiner* — Deborah Yee
(74) *Attorney, Agent, or Firm* — McDermott Will & Emery LLP

(57) ABSTRACT

It is an object of the present invention to provide a high strength cold-rolled steel sheet, which has superior bake hardenability, aging resistance at room temperature and secondary work embrittlement resistance, and a method for manufacturing the same. The steel sheet has a grain size of ASTM No. of 9 or more after annealing, a BH of 30 MPa or more, an AI of 30 MPa or less, and a tensile strength of 340~390 MPa through appropriate control of solute elements in steel by addition of a small amount of Ti, addition of Al and Mo, and control of manufacturing conditions, and refinement of crystal grains after annealing. The cold-rolled steel sheet and the galvannealed steel sheet produced using the cold-rolled steel sheet have the superior bake hardenability, aging resistance at room temperature, and secondary work embrittlement resistance.

3 Claims, 4 Drawing Sheets

(56) References Cited

U.S. PATENT DOCUMENTS

| | | | |
|---|---|---|---|
| 2002/0197508 | A1 | 12/2002 | Yoshinaga et al. |
| 2008/0251167 | A1 | 10/2008 | Han |

FOREIGN PATENT DOCUMENTS

| | | |
|---|---|---|
| JP | 05-171353 | 7/1993 |
| JP | 6-81121 | 3/1994 |
| JP | 6-116648 | 4/1994 |
| JP | 6-306531 | 11/1994 |
| JP | 7-278654 | 10/1995 |
| JP | 8-49038 | 2/1996 |
| JP | 9-249936 | 9/1997 |
| JP | 10-130733 | 5/1998 |
| JP | 10-183301 | 7/1998 |
| JP | 11-199991 | 7/1999 |
| JP | 2000-256786 | 9/2000 |
| JP | 2003-268490 | 9/2003 |
| KR | 10-2004-0054199 | 6/2004 |
| KR | 10-2004-0058489 | 7/2004 |
| KR | 10-2005-0068358 | 7/2005 |
| KR | 10-2005-0070305 | 7/2005 |

OTHER PUBLICATIONS

Machine-English translation of Japanese patent No. 11-199991, Tosaka Akio et al., Jul. 27, 1999.*

* cited by examiner

BAKE-HARDENABLE COLD ROLLED STEEL SHEET WITH SUPERIOR STRENGTH, GALVANNEALED STEEL SHEET USING THE COLD ROLLED STEEL AND METHOD FOR MANUFACTURING THE COLD ROLLED STEEL SHEET

CROSS-REFERENCE TO RELATED APPLICATIONS

The present application is a divisional of U.S. patent application Ser. No. 12/067,764, filed on Mar. 21, 2008, now U.S. Pat. No. 8,128,763 B2 which is a U.S. national stage entry under 35 U.S.C. §371 of International Patent Application PCT/KR2006/003778, filed Sep. 22, 2006, each of which is incorporated herein by reference in its entirety.

TECHNICAL FIELD

The present invention relates to a cold-rolled steel sheet for outer parts and the like of an automobile body, a galvannealed steel sheet using the cold-rolled steel sheet, and a method for manufacturing the same. More particularly, the present invention relates to a bake hardenable high strength cold-rolled steel sheet with superior aging resistance, a galvannealed steel sheet using the cold-rolled steel sheet, and a method for manufacturing the same.

BACKGROUND ART

For improvement in fuel efficiency and reduction in weight of automobiles, it has been increasingly demanded to improve dent resistance of an outer part and to reduce the thickness thereof by use of a high strength steel sheet for an automobile body.

As used for the outer part of the automobile body, a cold-rolled steel sheet is required to have good properties in terms of tensile strength, yield strength, press formability, spot weldability, fatigue resistance, corrosion resistance, etc.

In particular, the corrosion resistance has been recently required for extension in lifetime of components for the automobile.

Steel sheets for improvement in corrosion resistance can be generally classified into two types, i.e. a electroplated steel sheet and a galvannealed steel sheet.

In comparison with the steel sheet for galvannealing, although the steel sheet for electroplating has better plating properties and superior corrosion resistance, it is rarely used due to its very high price. Therefore, the galvannealed steel sheet is generally used in the art, and required to have improved corrosion resistance.

In recent years, most steelmaker in the world have produced the galvannealed steel sheets as materials for the automobiles, and supplied them to automobile manufacturers. Accordingly, new techniques capable of securing superior corrosion resistance above a conventional level have been continuously developed and increasingly used.

Generally, the steel sheet exhibits incompatible characteristics in terms of strength and formability. The steel sheets capable of satisfying both characteristics include multi-phase structure based cold-rolled steel sheets and bake hardenable cold-rolled steel sheets.

In general, the multi-phase structure based cold-rolled steel can be easily manufactured, and has high tensile strength at the level of 390 MPa or more. Furthermore, despite the higher tensile strength as compared with general materials for the automobiles, the multi-phase structure cold-rolled steel has high elongation, which is a factor of stretchability. However, it has a low average r-value as a factor of press formability of the automobiles, and comprises excessive amounts of expensive alloying elements such as Mn, Cr and the like, causing an increase in manufacturing costs.

The bake hardenable cold-rolled steel has yield strength approaching that of mild steel upon press forming of the steel which has a tensile strength of 390 MPa or less. Thus it has superior ductility, and spontaneously increases in yield strength upon paint baking after press forming. With these merits, the bake hardenable cold-rolled steel is spotlighted as ideal steel overcoming a disadvantage of conventional steel, of which formability is deteriorated in proportion to an increase of strength.

Bake hardening is a process which employs a kind of strain aging phenomenon occurring as interstitial elements, such as solute nitrogen or solute carbon, dissolved in a solid solution state in the steel pin dislocations created during deformation. When the steel has high amounts of solute carbon and nitrogen, a bake hardenability advantageously increases, but a natural aging property also increases due to such high amount of dissolved elements, thereby deteriorating the formability. Thus, it is very important to optimize the amount of dissolved elements in the steel.

As a method for manufacturing the bake hardenable cold-rolled steel sheet, batch annealing and continuous annealing are generally used.

Generally, the bake hardenable cold-rolled steel sheet is produced by batch annealing with a low carbon, P-added, Al-killed steel through coiling of a hot-rolled steel sheet at low temperatures. Specifically, when manufacturing the bake hardenable cold-rolled steel sheet using the Al-killed steel, the hot-rolled steel sheet is coiled at a low temperature in the range of 400~500° C., followed by batch annealing the hot-rolled steel to have bake hardenability (BH) value of about 40 to 50 MPa. This is because the batch annealing enables both formability and bake-hardenability to be obtained more easily at the same time.

Meanwhile, for the continuous annealing, since the P-added Al-killed steel is cooled at a relatively rapid rate, it is easy to secure the bake-hardenability, but there is a problem in that the formability is deteriorated due to rapid heating and a short annealing process. Thus, the continuous annealing-based steel sheet is restricted in use for the outer part of the automobile body, which do not require workability.

Recently, with rapid advances in steel manufacturing technique, it becomes possible to optimize the amount of dissolved elements in the steel, and to manufacture bake hardenable cold-rolled steel sheets with superior formability through addition of various carbide and nitride formation elements, such as Ti or Nb, to the Al-killed steel, thereby satisfying increasing demands for the bake hardenable cold-rolled steel sheets, which can be used for the outer part of the automobiles requiring dent resistance.

Japanese Patent Publication No. (Sho) 61-0026757 discloses an ultra low carbon cold-rolled steel sheet, which comprises: 0.0005~0.015% of C; 0.05% or less of S+N; and Ti and Nb or a compound thereof. Japanese Patent Publication No. (Sho) 57-0089437 discloses a method for manufacturing a bake hardenable cold-rolled steel sheet, which uses Ti-added steel comprising 0.010% or less of C, and has BH value of about 40 MPa or more.

The methods of the disclosures are to impart the bake hardenability to the steel sheet while preventing deterioration in other properties of the steel sheet by appropriately controlling the amount of dissolved elements in the steel through control of the added amount of Ti and Nb or the cooling rate during annealing.

However, for the Ti-added steel or Ti and Nb-added steel, it is necessary to strictly control the amounts of Ti, N and S during manufacture of the steel to ensure an appropriate BH value, causing an increase of manufacturing costs.

Furthermore, the Nb-added steel described above has problems in that operability is degraded due to high temperature annealing, and in that manufacturing costs are increased due to addition of specific elements.

On the other hand, U.S. Pat. Nos. 5,556,485 and 5,656 102 (Bethlehem Steel, Co., USA) disclose methods of manufacturing a bake hardenable cold-rolled steel sheet from Ti—V based ultra low carbon steel, which comprises 0.0005~0.1% of C; 0~2.5% of Mn; 0~0.5% of Al; 0~1.04% of N; 0~0.5% of Ti; and 0.005~0.6% of V.

Generally, since V is more stable than the carbide and nitride formation elements such as Ti and Nb, it can lower an annealing temperature. Hence, carbide, such as VC and the like, created during high temperature annealing can impart the bake hardenability to the eel via re-melting even with the lower annealing temperature than that for the Nb-based steel.

However, although V can create the carbide such as VC, since it does not sufficiently improve the formability due to its significantly low re-melting temperature, Ti is added in an amount of about 0.02% or more for the purpose of enhancing the formability, as disclosed in the publications Thus, the methods disclosed in the publications are disadvantage in terms of aging resistance due to coarse crystal grains, and suffer from an increase in manufacturing costs due to addition of large amounts of Ti.

Meanwhile, various methods of manufacturing the bake hardenable cold-rolled steel sheet through addition of alloying elements are disclosed in Japanese Patent Laid-open Nos. (Hei) 5-0093502, (Hei) 9-0249936, (Hei) 8-0049038 and (Hei) 7-0278654.

Japanese Patent Laid-open No. (Hei) 5-0093502 discloses a method for enhancing the bake hardenability through addition of Sn, and Japanese Patent Laid-open No. (Hei) 9-0249936 discloses a method for enhancing the ductility of steel by relieving stress concentration on grain boundaries through addition of V and Nb in combination.

Japanese Patent Laid-open No. (Hei) 8-0049038 discloses a method for enhancing the formability through addition of Zr, and Japanese Patent Laid-open No. (Hei) 7-0278654 discloses a method for enhancing the formability by increasing the strength while minimizing deterioration of work hardening index (N-value) through addition of Cr.

However, these methods only give attention to improvement in the bake hardenability or the formability, and do not disclose the problem of deterioration in aging resistance resulting from the improvement in bake hardenability, and the problem of secondary work embrittlement resulting from increase in content of P, which is necessarily added to increase the strength of the bake hardenable steel.

Generally, the increase of bake hardenability causes the deterioration of aging resistance at room temperature. In particular, the inventors have found that, with an increase in content of P added for high strength of the steel, the steel is degraded so much more secondary work embrittlement resistance even in the case of the bake hardenable steel which comprises dissolved carbon in the steel.

For example, when P was added in an amount of 0.07% to produce bake hardenable steel of the tensile strength at the level of 34 MPa, a ductility brittleness transition temperature (DBTT) of the steel as a reference to determine the second work embrittlement was −20° C. at a drawing ratio of 1.9. When P was added in an amount of about 0.09% to produce high strength steel at the level of 390 MPa, the DBTT of the steel was in the range of 0~10° C., from which it can be concluded that the steel is significantly deteriorated in secondary work embrittlement resistance.

In the methods described above, although boron (B) is added in an amount of about 5 ppm and expected to improve the secondary work embrittlement resistance, the excessive P content limits improvement in DBTT through addition of B.

Furthermore, if B is excessively added to the steel to improve the secondary work embrittlement resistance, the properties of the steel are deteriorated due to the excessive content of B. Thus, there is a limit in the amount of B which can be added to the steel.

Since the steel must have a DBTT of −20° C. or more to prevent the secondary work embrittlement, there are needs to investigate new compositions other than B for the bake hardenable steel and new manufacturing conditions therefor.

DISCLOSURE OF INVENTION

Technical Problem

Therefore, the present invention has been made in view of the above problems, and it is an object of the present invention to provide a high strength cold-rolled steel sheet with excellent bake hardenability, aging resistance at room temperature and secondary work embrittlement resistance, and a method for manufacturing the same.

It is another object of the present invention to provide a galvannealed steel sheet using the high strength cold-rolled steel sheet of the present invention.

Technical Solution

In accordance with one aspect of the present invention, the above and other objects can be accomplished by the provision of a bake hardenable cold-rolled steel sheet with high strength and superior aging resistance (which can also hereinafter be referred to as a "high temperature coiled steel sheet", comprising, by weight %,: C: 0.0025~0.0035%; Si: 0.02% or less; Mn; 0.2~1.2%; P: 0.05~0 11%; S: 0.01% or less; Soluble Al: 0.08~0.12%; N: 0.0025% or ess; Ti: 0.005~0.018%; Mo: 0.1~0.2%; B: 0.0005~0.0015%; and the balance of Fe and other unavoidable impurities, wherein the steel sheet satisfies Equation 1: Ti*[Effective Ti]=Total Ti−(48/14)N−(48/32) S≦0 - - - (1), and wherein the steel sheet has a bake hardening degree (BH) of 30 MPa or more, an aging index (Al) of 30 MPa or less, a DBTT of −30° C. or less at a drawing ratio of 2.0 and an ASTM grain size (hereinafter referred to as "ASTM No." of 9 or more.

In accordance with another aspect of the invention, a galvannealed steel sheet produced using the bake hardenable cold-rolled steel sheet of the present invention is provided.

In accordance with yet another aspect of the invention, a method for manufacturing a bake hardenable cold-rolled steel sheet with high strength and superior aging resistance (which can also hereinafter be referred to as a "method for manufacturing a high, temperature coiled steel sheet" is provided, comprising: performing homogenization heat treatment for an Al-killed steel slab at 1,200° C. or more, the steel slab comprising, by weight %,: C: 0.0025~0.0035%; Si: 0.02% or less; Mn: 0.2~1.2%; P: 0.05~0.11%; S: 0.01% or less; Soluble Al: 0.08~0.12%; N: 0.0025% or less; Ti: 0.005~0.018%; Mo; 0.1~0.2%; B: 0.0005~0.0015%; and the balance of Fe and other unavoidable impurities, wherein the steel slab satisfies Equation 1: Ti*[Effective Ti]=Total Ti−(48/14)N−(48/32)S≦0 - - - (1); hot rolling the steel slab with finish rolling at a finish rolling temperature of 900~950° C. to form a hot-rolled steel sheet, followed by coiling the hot-rolled steel sheet at a temperature of 600~650° C.; cold rolling the hot-rolled steel sheet at a reduction ratio of 75~80%; continuously annealing the cold rolled steel sheet at a temperature of 760~790° C.; and temper rolling the annealed steel sheet at a reduction ratio of 1.2~1.5%.

In accordance with yet another aspect of the present invention, a high strength cold-rolled steel sheet with superior bake hardenability (which can also hereinafter be referred to as a "low temperature coiled steel sheet" is provided, comprising, by weight %,: C: 0.0016~0.0025%; Si: 0.02% or less; Mn: 0.2~1.2%; P: 0.05~0.11%; S: 0.01% or less; Sol, Al: 0.08~0.12%; N: 0.0025% or less; Ti: 0.008~0.018%; Mo: 0.1~0.2%; B 0.0005~0.0015%; and the balance of Fe and other unavoidable impurities, wherein the steel sheet satisfies Equations 1 and 2:

$$\text{Ti*[Effective Ti]=Total Ti}-(48/14)\text{N}-(48/32)\text{S}\leqq 0 \quad (1)$$

$$\text{C*[amount of solute carbon in grain boundaries (GB-C)+amount of solute carbon in crystal grains (G-C)]=Total C (ppm)}-\text{C in TiC}=8\sim 15\text{ ppm} \quad (2)$$

[in Equation 2, GB-C (that is, the amount of solute carbon in the grain boundaries) is 5~10 ppm, and G-C (that is the amount of solute carbon in the crystal grains) is 3~7 ppm], and wherein the steel sheet has ASTM No. of 9 or more, BH value of 30 MPa or more, aging index (AI) of 30 MPa or less, and tensile strength of 340~390 MPa.

In accordance with yet another aspect of the invention, a galvannealed steel sheet produced using the high strength cold-rolled steel sheet of the above aspect is provided.

In accordance with yet another aspect of the invention, a method for manufacturing a high strength cold-rolled steel sheet with superior bake hardenability (which can also hereinafter be referred to as a "method for manufacturing a low temperature coiled steel sheet" is provided, comprising: performing homogenization heat treatment for an Al-killed steel slab at 1,200° C. or more, the steel slab comprising, by weight %,: C: 0.0016~0,0025%; Si: 0.02% or less; Mn: 0.2~1.2%; P: 0.05~0.11%; S: 0.01% or less; Sol. Al: 0.08~0.12%; N: 0.0025% or less; Ti: 0.008~0.018%; Mo; 0.1~0.2%; B: 0.0005~0.0015%; and the balance of Fe and other unavoidable impurities, wherein the steel sheet satisfies the Equation 1; hot rolling the steel slab with finish rolling at a finish rolling temperature of 900~950° C. to form a hot-rolled steel sheet, followed by coiling the hot-rolled steel sheet at a temperature of 500~550° C.; cold rolling the hot-rolled steel sheet at a reduction ratio of 75~80%; continuously annealing the cold rolled steel sheet at a temperature of 770~830° C.; and temper rolling the annealed steel sheet at a reduction ratio of 1.2~1.5%.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
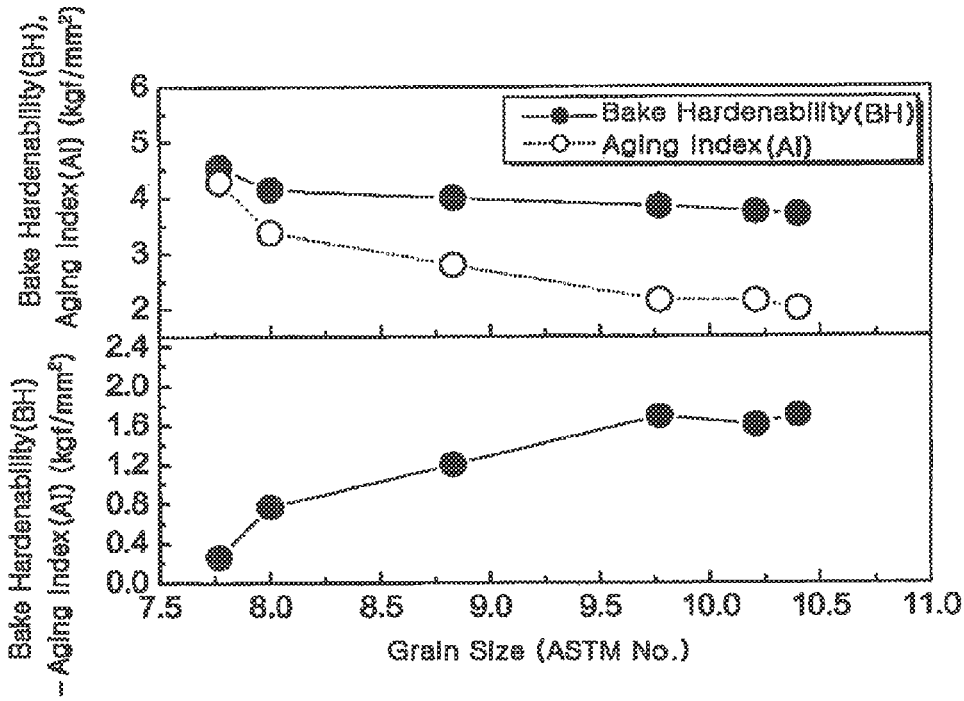
FIG. 1 is a graph describing influence of a grain size on bake hardenability and aging index.

Preferred embodiments of the invention will now be described in detail.

Carbon or nitrogen in steel generally combines with precipitate formation elements such as Al, Ti, Nb, etc. in the steel during hot rolling, forming carbides and nitrides such as TiN, AlN, TiC, $Ti_4C_2S_2$, NbC, etc. Some of carbon or nitrogen not combining with the precipitation formation elements in the steel exist as solid solutions of carbon or nitride (hereinafter, solute carbon or solute nitrogen) in the steel, and influences bake hardenability and aging resistance of the steel.

In particular, since nitrogen has a higher diffusion rate than that of carbon, it is very detrimental to the aging resistance in comparison with an improved degree of the bake hardenability. Hence, it is general in the art to remove as much nitrogen from the steel as is possible. In particular, since Al or Ti is preferentially precipitated along with nitrogen prior to carbon at high temperatures, it can be generally concluded that there is substantially no influence of nitrogen in the steel on the bake hardenability and aging resistance.

However, carbon is an essential element for the steel, and determines characteristics of the steel dependant on carbon content in the steel.

For the bake hardenable steel sheet according to the present invention, carbon has a very important role, and only a small amount of solute carbon is allowed to remain in the steel as an attempt to improve the bake hardenability and aging resistance.

However, influence of the solute carbon on the bake hardenability and aging resistance can be changed depending on locations of the solute carbon in the steel, that is whether the solute carbon resides in grain boundaries or in crystal gains.

That is, the solute carbon capable of being detected via an internal friction test generally exists in the crystal grains and moves relatively freely. Thus, the solute carbon in the crystal grains can combine with movable dislocations, and affect aging properties. A factor used for evaluating the aging properties is an aging index (AI).

Generally, if steel has Al of 30 MPa or more, aging can occur within six months after maintaining the steel at room temperature, causing severe defects upon press working.

However, when the solute carbon resides in the grain boundaries which are a relatively stable region, it is difficult to detect such solute carbon via a vibration test such as the internal friction test.

Since the solute carbon has a relatively stable state in the grain boundaries, the solute carbon therein rarely affects aging at low temperatures such as AI test. However, it is activated in a baking condition of high temperatures, and can affect the bake hardenability.

Hence, it can be concluded that the solute carbon in the crystal grains can affect both aging properties and bake hardenability, whereas the solute carbon in the grain boundaries affects only the bake hardenability.

In this regard, reports say that, since the grain boundaries are the relatively stable region, not all the solute carbon in the grain boundaries affects the bake hardenability, but only about 50% of the solute carbon in the grain boundaries affects the bake hardenability.

Hence, it is possible to secure the bake hardenability and aging resistance at the same time through an appropriate control on location of the solute carbon in the steel, namely, by controlling the solute carbon to reside in the grain boundaries rather than in the crystal grains as much as possible.

For this purpose, it is important to control a grain size with an added amount of carbon in the steel.

This is because it is difficult bake hardenability and aging resistance at the same time even with control of the location of the solute carbon, if the added amount of the carbon is excessively high or low in the steel.

FIG. 1 shows BH value and an aging index (AI) in relation to variation in grain size, which was obtained from investigation by the inventors.

As can be seen From FIG. 1, in comparison with the BH value, AI is decreased so much more severely with an increase in ASTM No. of crystal grains, that is, as the crystal grains become finer, causing a gradual increase in value of BH-AI and finally providing superior aging resistance.

On the basis of the results shown in FIG. 1, the inventors tried to decrease a grain size of an annealed sheet to the proper level or less to make the solute carbon distributed as much as possible into the grain boundaries of the steel sheet.

According to the results, the inventors have found that the grain size is desirably controlled to ASTM No. of 9 or more to maximize the aging resistance while minimizing deterioration in bake hardenability.

Meanwhile, even when a great amount of solute carbon is distributed into the grain boundaries, it is necessary to strictly control a total added amount of carbon in the steel.

This is attributable to the fact that, despite reduction in grain size, an excessive increase of carbon content in the steel causes an increase of an amount of solute carbon in the crystal grains in proportion to the total added amount of carbon, deteriorating the bake hardenability.

According to the invention, the total amount of carbon is set to 25~35 ppm for high temperature coiled steel to satisfy the aforementioned conditions.

On the other hand, for a low temperature coil steel (coiling temperature: 500~550° C.), the total amount of carbon is set to 16~25 ppm. Difference in the total amount of carbons between the coiling temperatures will be described below.

Figure 2:
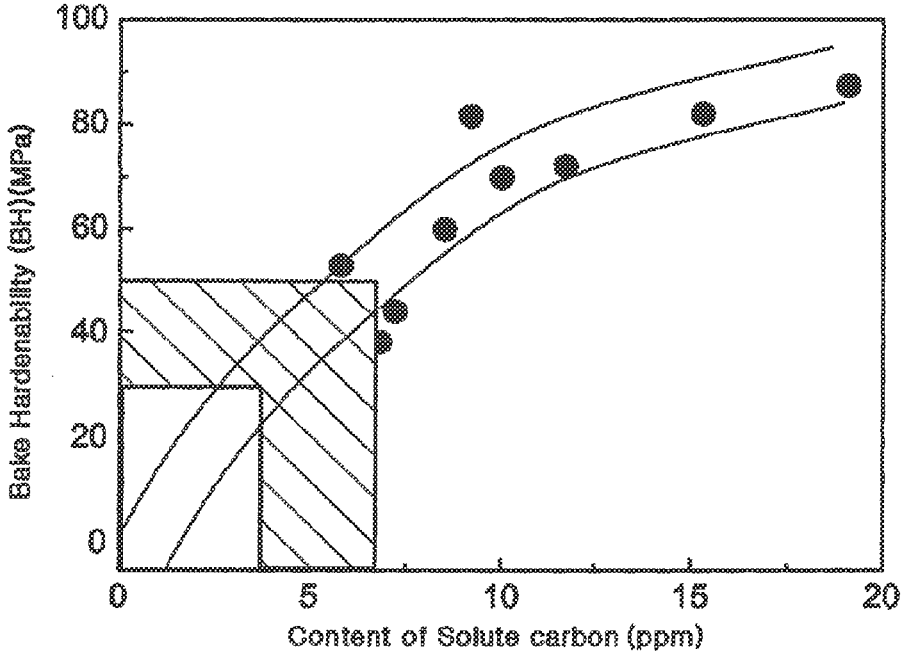
FIG. 2 is a graph describing influence of an amount of solute carbon in steel on the bake hardenability.

With investigation into influence of the solute carbon in the steel to satisfy both bake hardenability and aging resistance under the above conditions, the inventors have found results shown in FIG. 2 where the steel has a very fine grain size of ASTM No. of 9 or more as in the present invention.

As shown in FIG. 2, from the results obtained by investigating change in bake hardenability related to change in amount of solute carbon in Ti or Nb-added ultra low carbon steel which has fine crystal grains, it has been found that an amount of solute carbon in the grain boundaries satisfying the BH value of 30~50 MPa set in consideration of the aging resistance is about 3~7 ppm.

Furthermore, it has also been found that the total amount of solute carbon is about 8~15 ppm, wherein the total amount of solute carbon is obtained by excluding an amount of TiC precipitates in consideration of the added amount of Ti and the carbon content in the steel of the present invention.

With these results, it is possible to obtain a condition which can satisfy both bake hardenability and aging resistance, that is, Equation 2:

$$C^*[\text{amount of solute carbon in grain boundaries (GB-C)}+\text{amount of solute carbon in crystal grains (G-C)}]\times\text{Total C (ppm)}-\text{C TiC}=8\sim15\text{ ppm} \quad (2)$$

where GB-C (that is the amount of solute carbon in the grain boundaries) is 5~10 ppm, and G-C (that is, the amount of solute carbon in the crystal grains) is 3~7 ppm.

It is possible to secure the bake hardenability and aging resistance needed for the steel according to the invention by allowing about 3~7 ppm of solute carbon to reside in the crystal grains as indicated by Equation 2.

However, even with the control of the carbon content as described above, if higher Ti is added rather than that of Ti forming precipitates such as TIN or TiS in the Ti-added ultra low carbon steel, the remaining Ti is coupled with carbon, and forms the carbide such as TiC.

In addition, for this condition, it is difficult to control a suitable amount of solute carbon since the amount of solute carbon remaining in the steel is changed according to change in Ti content in the steel.

In order to solve the above problem, the present invention is to control all added carbon to remain in the steel by adding a smaller amount of Ti to the steel than an amount of Ti coupled to S and N according to Equation 1:

$$Ti^*[\text{Effective Ti}]=\text{Total Ti}-(48/14)N-(48/32)S\leqq \quad (1)$$

Meanwhile, according to the invention, effect of AlN precipitates obtained through addition of Al is also considered as well as the addition of Ti in order to obtain more stable the, bake hardenability and aging resistance.

Generally, in Ti-added steel having a low Al content, since most nitrogen is precipitated to coarse TiN or AlN at high temperatures of 1,300° C. or more, nitrogen has an insignificant influence on a solid solution hardening effect or a grain refining effect in the steel.

Thus, AlN has only an effect of removing the solute nitrogen in the steel like the TiN precipitates.

According to results of various investigations using the steel of the present invention, since the carbon content of the inventive steel is very strictly restricted to be in the range of 25~35 ppm for the high temperature coiled steel and to be in the range of 16~25 ppm for the low temperature coiled steel, the bake hardenable steel of the invention has the bake hardenability and aging resistance in a narrow range.

Since customers demand the bake hardenable steel to have a higher BH value and aging resistance of 6 months or more at room temperature, there are needs of techniques which can improve the bake hardenability as much as possible without reducing the aging resistance.

In this point of view, Al is very effective. That is, when Sol. Al is added in a typical amount of 0.02~0.06% to the steel, it serves simply to pin the solute nitrogen. However, when Sol, Al is added in an amount of 0.08% or more, AlN precipitates become very fine, and act as a kind of barrier which obstructs growth of crystal grains during recrystallization annealing, so that the grains of the steel become finer than that of the Ti-added steel without Sol. Al, thereby providing an effect of improving the bake hardenability without reducing the AI.

Figure 3:
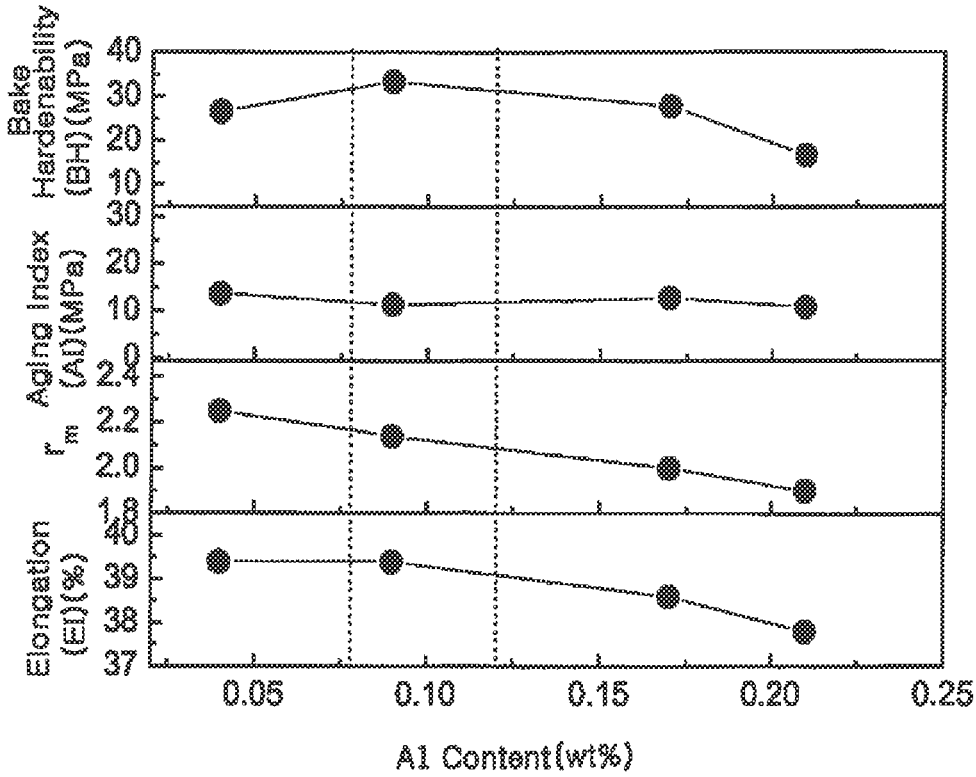
FIG. 3 is a graph describing influence of Al content on mechanical properties of steel.

FIG. 3 is a graph describing change in mechanical properties of galvannealed steel according to change in Sol. Al content.

As can be seen from FIG. 3, the BH value increases and then decreases with increase in Al content, and the content of Sol. Al capable of providing the bake hardenability to the steel is in the range of about 0.08~0.12%. If the Sol. Al content is deviated from this range, an r-value and elongation exhibiting the formability are lowered, and oxide inclusions are increased in amount during manufacture of steel due to excessive addition of Sol. Al, causing deterioration in surface quality.

With the investigation as described above, the inventors suggest that the Sol. Al content be in the range of 0.08~0.12%.

The following Equation 3 shows influence of Sol. Al added in the range of the present invention on improvement of the bake hardenability in a statistical manner.

$$BH=50-(885\times Ti)+(62\times Al) \quad (3)$$

In the steel according to the invention, the contents of Ti and Al are preferably controlled to have a bake hardening degree of 30 MPa or more according to the above equation 3.

In the present invention, a high temperature coiling temperature is one of the very important factors in addition to the contents of C, soluble Al and Ti. In particular, the coiling temperature acts as a very Important factor to determine a total carbon content necessary for the steel of the invention to compatibly ensure both bake hardenability and aging resistance at room temperature.

Specifically, even when attempting to improve the bake hardenability and aging resistance through the grain refining effect by addition of Ti, if the coiling temperature is excessively elevated, the grains become coarse during hot rolling, which results in a grain size of ASTM No. of 9 or less during the recrystallization annealing, so that the AI exceeds 30 MPa, which is the upper limit of the present invention. On the other hand, if the coiling temperature is lowered to a predetermined value or less, the aging resistance at room temperature can be improved. However, grain refining becomes very severe, and, for the Ti-added steel, the solute carbon is increased in amount, causing an increase in yield strength while decreasing the elongation and r-value, thereby deteriorating the formability and the aging properties.

Furthermore, in terms of the total added amount of carbon, it is necessary for the steel having a carbon content of 25~35 ppm to have a coiling temperature controlled to be in a narrow range of 600~650° C., and for the steel having a carbon content of 16~25 ppm to have a coiling temperature controlled to be in the range of 500~550° C., in order to compatibly secure the suitable bake hardening degree and aging resistance at room temperature through control of the coiling temperature.

The present invention will be described in detail hereinafter.

Generally, for a Ti-added ultra low carbon steel sheet, Ti precipitates formed in the steel include TiN, TiS, $Ti_4C_2S_2$, FeTiP, TiC, etc.

Among these precipitates, FeTiP is formed in the event that P is added in a high amount of 0.04% or more, and $Ti_4C_2S_2$ is formed in the event that homogenizing heat treatment of a steel slab is performed at a low temperature of 1,200° C. or less and P content is 0.04% or less in the steel, It is noted that $Ti_4C_2S_2$ and FeTiP are not formed in the steel of the present invention.

If Ti is added Stoichiometric range or more, that is, $Ti \geqq (48/14)N+(48/32)S$, the Ti-precipitates such as TiN, TiS, TiC and the like are formed.

On the other hand, although it has been known that the TiC precipitates are not formed in the steel when Ti is added to the steel in an amount less than or equal to the Stoichiometric range, it was verified by many investigators including the inventors of the present invention that a small amount of Ti precipitates are formed even in the Ti Stoichiometric range or less.

Figure 4:
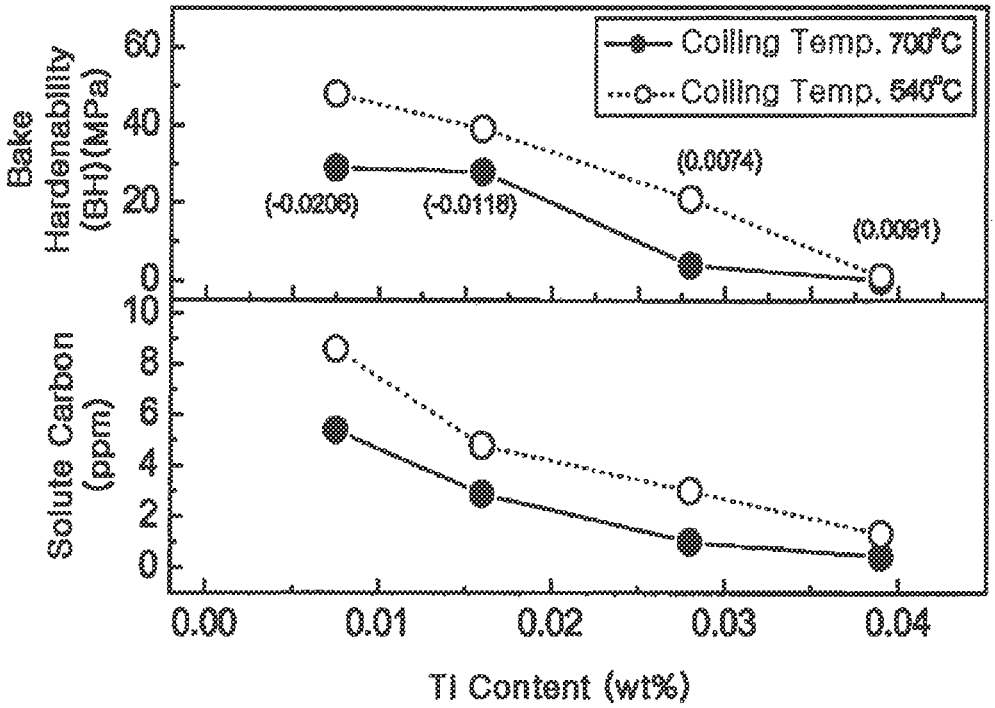
FIG. 4 is a graph describing influence of coiling temperature on BH value and the amount of solute carbon in steel according to an added amount of Ti.

FIG. 4 is a graph describing change in bake hardening degree and amount of solute carbon in steel in relation to Ti content by use of Ti-added steel sheets which were coiled at temperatures of 700° C. and 540° C., respectively.

As can be seen from FIG. 4, an increase of Ti content causes a gradual decrease of BH value and amount of solute carbon in the steel.

However, in the same Ti content, the BH value and the amount of solute carbon are higher in the steel coiled at the low temperature of 540° C. than in the steel coiled at the high temperature of 700° C.

With results of observation of samples formed through two different coiling conditions by use of electron microscopy, it can be understood that the above phenomenon is caused by precipitation of TiC. In other words, for the high temperature coiled steel, a significant amount TiC precipitates resided in the steel, and for the low temperature coiled steel, very few TiC precipitates were observed. Thus, it could be concluded that, although carbon resides as the TiC precipitates in the high temperature coiled steel, most of carbon resides in a solid solution state in the low temperature coiled steel, and increases the BH value.

Generally, the TiC precipitates are stabilized upon high temperature coiling at the temperature of 700° C. or more. Thus, since it is necessary to perform annealing at high temperatures of 860° C. or more in order to obtain solute carbon through re-melting of the TiC precipitates during continuous annealing, there occurs a problem of deterioration in workability as well as buckling during the annealing.

However, the present inventors have found that coiling at the temperatures of 550° C. or less allowed the TiC precipitates to be maintained as metastable precipitates, thereby permitting the solute carbon to be obtained through re-melting of the TiC precipitates even in continuous annealing at the temperatures in the range of 770~830° C. which is a typical annealing temperature range for the ultra low carbon steel.

From these results, it can be verified that the total added amount of carbon to the low temperature coiled steel must be smaller than that of the high temperature coiled steel, and that it is suitable to manage the total added amount of carbon to be in the range of 25~35 ppm for the high temperature coiled steel and to be in the range of 16~25 ppm for the low temperature coiled steel according to the present invention.

Meanwhile, in terms of secondary work embrittlement, it can be considered that components of automobiles are generally formed to desired shapes through several iterations of press forming by automobile manufacturers. In this regard, the secondary work embrittlement means that cracks are formed during a process performed after primary press forming. When P resides in the grain boundaries of the steel, it weakens a bonding force between the grains so that the cracks propagate along the grain boundaries, causing fracture of the steel.

Basically, it is desirable that P is not added to the steel in order to prevent the secondary work embrittlement. However, P has merits in that it resides as solute P in the steel, generally serving to increase the strength of steel while suppressing reduction in elongation, and in that it is very low in price.

Thus, although it is considered that P is basically added for high strength of the steel, there are also investigations to increase the strength of steel through addition of other solute elements instead of P in order to prevent the secondary work embrittlement notwithstanding a slight increase in manufacturing costs.

From results of the investigations, however, it is expected that P will be used as a strengthening element of the steel for the time being.

As a method of improving the secondary work embrittlement resistance in such P-added steel, there is an attempt to promote a site competition effect between boron and phosphorus or increase the bonding force between the grain boundaries by allowing solute elements to remain in the steel or by adding B and the like. Otherwise, it has been attempted to minimize boundary diffusion of P by lowering the coiling temperature to a predetermined temperature or less during the hot rolling. However, these attempts do not completely solve the problem of the secondary work embrittlement.

In this regard, the present invention suggests addition of Mo to improve the secondary work embrittlement resistance more stably.

From results of investigation by the present inventors, since Mo improves the bonding force between the grain boundaries, it is very advantageous to improve the secondary work embrittlement resistance.

In addition, due to an affinity to the solute carbon in the steel, Mo suppresses diffusion of the solute carbon into dislocations while being maintained for a long period of time at room temperature, providing an advantageous effect in terms of aging resistance.

Figure 5:
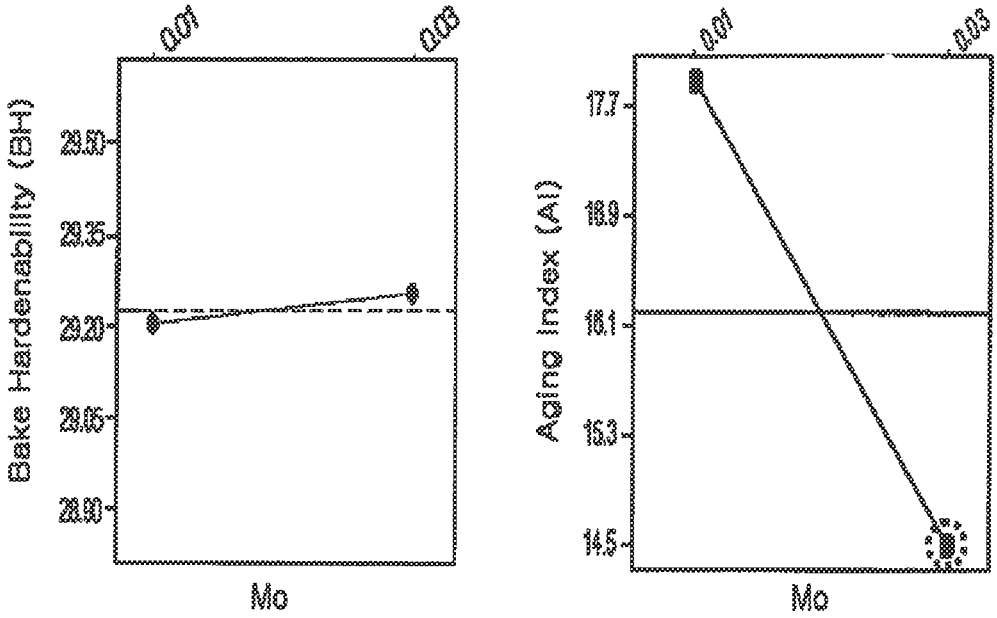
FIG. 5 is a graph describing influence (statistical analysis) of Mo content on the bake hardenability and aging index.

FIG. 5 shows effect of Mo on improvement in aging resistance through analysis using a statistical method.

As can be seen from FIG. 5, although an increase in Mo content provides no significant difference in BH value, it causes a decrease in AI.

From the results of the investigations, it is possible for the Nb-added steel to have an improvement in the aging resistance only with Mo content of 0.1% or less. On the other hand, since the Ti-added steel like the inventive steel has a grain size and an added amount of carbon somewhat greater than the Mo-added steel, it is necessary to increase the Mo content in order to ensure the improvement of the aging resistance.

For this purpose, the aging resistance depending on an added amount of Mo in the Ti-added steel was evaluated, and it could be found that addition of Mo in an amount of 0.1~0.2% was very effective for improving the aging resistance and secondary work embrittlement resistance.

The following Equation 4 shows an effect of improving the aging resistance by addition of Mo in the Ti-added steel by a statistical manner, $$AI=44-(423\times Ti)-(125\times Mo) \quad (4)$$

For the steel sheet according to the invention, the contents of Ti and Mo are preferably controlled to have an aging index (AI) of 30 MPa or less according to Equation 4.

Furthermore, the inventors tried to maximize the effect of improving the secondary work embrittlement resistance through addition of a suitable amount of B, selection of a suitable coiling temperature, etc. at the same time among various methods conventionally used to improve the secondary work embrittlement resistance.

The bake hardenable steel according to the present invention will be described in detail hereinafter in terms of composition and manufacturing conditions.

Carbon (C) is an element used for solid solution strengthening and bake hardenability.

First, for the high temperature coiled steel sheet, if carbon content is less than 0,0025 wt. % (hereinafter, %), the tensile strength of steel is significantly lowered due to such a low content of carbon, and sufficient bake hardenability cannot be obtained due to a low absolute content of carbon in the steel even when Ti is added up to such a degree of satisfying Equation 1.

If the carbon content exceeds 0.0035%, a grain refining effect is very significantly increased for Nb-added steel, thereby providing a very high BH value while improving the secondary work embrittlement resistance. However, in this case, since the aging resistance at room temperature cannot be obtained due to an excessive remaining quantity of solute carbon, stretcher strain occurs during press forming, causing deterioration in formability and ductility of the steel.

Thus, the carbon content is preferably in the range of 0.0025~0.0035%.

Next, for the low temperature coiled steel sheet, if the carbon content is 0.0016% or less, although it has a relatively higher content of solute carbon compared with the high temperature coiled steel sheet, the carbon content of 0.0016% or less is still a very, low level for the low temperature coiled steel sheet. Thus, in this case, the tensile strength is insufficient, and sufficient bake hardenability cannot be obtained due to a low absolute content of carbon in the steel even when the solute carbon is obtained by adding Ti up to such a degree of satisfying Equation 1 or by re-melting a small amount of TiC precipitate formed by low temperature coiling in continuous annealing.

Furthermore, the secondary work embrittlement resistance is significantly deteriorated since the site competition effect between the solute carbon and P is eliminated.

If the carbon content exceeds 0.0025%, desired aging resistance at room temperature cannot be obtained despite a very high BH value due to an excessive quantity of solute carbon above 3~7 ppm of the present invention in the crystal grains of the steel, and thus stretcher strain occurs during press forming, causing deterioration in formability and ductility of the steel. Thus, the carbon is preferably in the range of 0.0016~0.0025%.

Silicon (Si) is an element used for increasing the strength of steel. As the silicon content is increased, the ductility is noticeably deteriorated. Since silicon deteriorates galvannealing capability, it is advantageous to add as low an amount of silicon in the steel as is possible.

According to the invention, in order to prevent deterioration of the properties including plating properties of the steel due to Si, the added amount of Si is preferably 0.02% or less.

Manganese (Mn) is an element used for preventing hot embrittlement caused by formation of FeS, and for strengthening the steel by completely precipitating sulfur in the steel into MnS while refining the crystal gains without deteriorating the ductility. According to the invention, if Mn content is less than 0.2%, a suitable tensile strength cannot be obtained, whereas if the Mn content exceeds 1.2%, the formability is deteriorated along with a rapid increase in strength due to solid solution strengthening. Particularly, when manufacturing a galvannealing steel sheet using such steel, a great amount of oxides, such as MnO, and a number of coating defects, such as stripe patterns, are formed on the surface of the steel sheet during annealing, thereby deteriorating plating adhesion and other properties of the steel. Thus, the Mn content is preferably in the range of 0.2~1.2%.

Phosphorus (P) is a substitutional alloying element which has the highest solid solution strengthening effect among various alloying elements, and serves to improve in-plane anisotropy while increasing the strength of the steel.

From the results of the investigation, P causes crystal grains of a hot-rolled steel sheet to become finer, promoting development of the (111) texture, which is advantageous to improve an average r-value, during an annealing process. In particular, it has been found that, due to the site competition effect between P and carbon in view of influence on the bake hardenability, the bake hardenability is tend to improve in proportion to an increase of P content.

However, the increase in P content causes a problem of deteriorating the secondary work embrittlement resistance by weakening the bondling force between the grain boundaries.

If the P content>is less than 0.05%, the secondary work embrittlement resistance can be improved due to such a low P content in the grain boundaries, but it is difficult to sufficiently obtain the effect of improving the other properties of the steel through grain refining by P. On the other hand, if the P content exceeds 0.11%, there occurs a more rapid increase in strength compared with an improved degree of the formability. In addition, such a high P content is likely to increase likelihood of the secondary work embrittlement through segregation of P in the grain boundaries. Thus, the P content is preferably in the range of 0.05~0.11%.

Sulfur (S) is an element which is precipitated into sulfides such as MnS at high temperatures, and serves to prevent the hot embrittlement caused by FeS.

However, if S content is excessive, some of S remaining after precipitation of MnS makes the grain boundaries brittle, possibly causing the hot embrittlement.

Furthermore, if S is added in an amount of allowing complete precipitation of MnS, such a large amount of S can cause deterioration in properties of the steel due to excessive precipitation. Thus, S is preferably in the range of 0.01% or less.

Aluminum (Al) is an element which is generally used for deoxidization of the steel. However, in this invention, aluminum is used for attain an effect of improving the grain refining effect and the bake hardenability through precipitation of AlN.

As can be seen from Equation 3, as an added amount of Al is increased, it is more advantageous in view of the bake hardening degree. In this invention, the grain refining effect is improved through precipitation of a great amount of AlN, thereby enhancing the bake hardenability without deteriorating the aging resistance.

Considering the other properties of the steel, however, it is necessary to have a suitable content of Al.

According to the present invention, Al is preferably added in an amount of 0.08% or more in order to achieve advantageous effects by addition of Al.

When the Al content is above 0.12%, oxide inclusions are increased during manufacture of the steel and cause degradation of surface quality along with deterioration of the formability. Furthermore, the excessive content of Al results in high manufacturing costs. Thus, the Al content is preferably in the range of 0.08~0.12%.

Nitrogen (N) exists in the solid solution state before or after annealing, and deteriorates the formability of the steel. Furthermore, since nitrogen imparts a faster aging characteristic than other interstitial solid solution elements, it is necessary to fix nitrogen by use of Ti or Al.

Since nitrogen has a higher diffusion speed than carbon, when nitrogen exists as solute nitrogen in the steel, the aging resistance at room temperature is deteriorated significantly more than the case by so carbon.

In addition, since the yield strength and the r-value of steel are lowered due to the solute nitrogen, it is preferable to have a nitrogen content of 0.0025% or less.

Titanium (Ti) is added to the steel as one of carbide and nitride formation elements, and forms nitride such as TiN, sulfide such as TiS or $Ti_4C_2S_2$, and carbide such as TiC, in the steel.

In the present invention, it is necessary to control the Ti content to satisfy Equation 1 so as to allow the solid carbon to reside in the steel.

Although 0.005% or less of Ti satisfies Equation 1, such a significantly small amount of Ti causes an increase of the grain size, which eliminates the grain refining effect.

In other words, such a small amount of Ti makes it difficult to achieve the improvement in aging resistance through the grain refining effect, thereby deteriorating the aging resistance. Furthermore, such a small amount of Ti causes deterioration in the formability such as elongation and r-value due to the solute carbon in the steel.

The Ti content exceeding 0.018% does not satisfy the condition of Equation 1, thereby causing reduction of the bake hardenability resulting from reduction in amount of the solute carbon in the steel.

As such, for the high temperature coiled steel sheet of the invention, the Ti content is preferably in the range of 0.005~0.018% while satisfying Equation 1.

On the other hand, for the low temperature coiled steel sheet of the invention, the Ti content, is preferably in the range of 0.008~0.018% while satisfying Equation 1.

Molybdenum (Mo) is another very important element of the present invention.

Mo exists in the solid solution state in the steel, and serves to enhance the strength of the steel or to form Mo-based carbide. In particular, Mo serves to increase the coupling force of the grain boundaries while being dissolved as a solute element in the steel, so that fracture of the grain boundaries due to phosphorus is prevented, that is, the secondary work embrittlement resistance is improved. In addition, since Mo has an affinity to carbon, it serves to suppress diffusion of carbon in the steel, improving the aging resistance.

For this purpose, it is necessary to add a suitable amount of Mo.

If Mo is added in an amount less than 0.1%, the above effects cannot be obtained for the Ti-added steel.

If the Mo content exceeds 0.2%, the effect of improving the secondary work embrittlement resistance or the aging resistance is insignificantly lower than a desired effect through addition of Mo, and manufacturing costs are noticeably increased due to the addition of Mo. Thus, when considering the manufacturing costs and the effect desired by the addition of Mo, Mo content is preferably in the range of 0.1~0.2%.

Equation 4 indicates the effect of improving the aging resistance in a quantitative manner.

Boron (B) resides in the steel an interstitial element, B is dissolved as a solid solution element in the grain boundaries or combines with nitrogen to form nitride such as BN. Since B has a highly significant influence on the properties of the steel compared with an added amount, it is necessary to precisely control the amount of B.

That is, when even a small amount of B is added, B is segregated in the grain boundaries and improves the secondary work embrittlement resistance. However, an excessive amount of B causes significant deterioration in ductility along with an increase of the strength. Thus, it is necessary to add a suitable amount of B.

According to the invention, considering these characteristics of B and capability of manufacturing the steel through addition of B, the B content is preferably in the range of 0.0005~0.0015%.

A method for manufacturing steel of the invention will now be described.

After preparing a steel slab having the composition as described above, the steel slab is reheated at a temperature of 1,200° C. or more, where austenite structure prior to hot rolling can be sufficiently homogenized. The reheated steel slab is then subjected to hot-rolling with finish rolling at a finish rolling temperature of 900~950° C., which is just above the $Ar_3$ transformation point, providing a hot rolled steel sheet.

If the steel slab is reheated at a temperature less than 1,200° C., the steel is likely to have mixed grain sizes, and cannot have homogeneous austenite crystal grains, causing deterioration in properties of the steel.

If the finish hot rolling temperature is less than 900° C., a top portion, a tail portion, and an edge of a hot-rolled coil become single-phase regions, thereby increasing in-plane anisotropy while deteriorating formability of the sheet steel.

If the finish hot rolling temperature is above 950° C., crystal grains of the steel become noticeably coarsened, causing defects such as orange peel to be formed on the surface of the steel sheet after machining.

For the inventive steel comprising carbon added in an amount of 25~35 ppm for the purpose of ensuring a suitable grain refining effect to provide a grain size of ASTM No. of 9 or more after the hot rolling while preventing deterioration in formability due to excessive grain refining, it is necessary to perform coiling of the steel sheet at a temperature of 600~650° C. If the coiling is performed exceeding 650° C., the steel sheet has an increased grain size after annealing, failing to achieve a sufficient grain refining effect even though the steel sheet satisfies the composition of the present invention in terms of carbon and Ti contents. Furthermore, segregation of P is increased, causing deterioration in secondary work embrittlement resistance.

If the coiling is performed below 600° C., the grains are severely fine, causing an excessive increase in tensile strength and deterioration in formability notwithstanding improvement in aging resistance and secondary work embrittlement resistance.

On the other hand, for the inventive steel having a total carbon content of 0.0016~0.0025%, the coiling is preferably performed at a temperature of 500~550° C.

If the coiling is performed exceeding 550° C., it is possible to slightly improve the formability by an increase of the grain size, but it is difficult to obtain sufficient bake hardenability due to stabilization of a small amount of TiC precipitates.

In addition, since it is necessary to anneal the steel sheet at a high temperature of 860° C. or more in order to secure a suitable amount of solute carbon by re-melting of the TiC precipitates, operability is deteriorated during annealing.

If the coiling temperature is below 500° C., suitable bake hardenability is secured by re-melting of the TiC precipitates after continuous annealing. However, the steel sheet has noticeably refined crystal grains due to such an excessively low coiling temperature, thereby deteriorating the formability and hot-rolling workability for the low temperature coiling.

After finishing the hot rolling, the steel sheet is subjected to acid pickling in a typical manner, cold rolling is performed at a cold reduction ratio of 75~80%.

Such a high reduction ratio of 75% or more is set for the purpose of enhancing the formability of the steel sheet, in particular, the r-value, in combination with the aging resistance through the grain refining effect according to the present invention.

If the reduction ratio is above 80%, the steel sheet has a high grain refining effect. However, such an excessive reduction ratio results in disadvantageous hardening of the steel sheet due to excessive grain refinement, and gradual decrease of the r-value.

For the steel sheet subjected to high temperature coiling, continuous annealing is performed at a temperature of 760~790° C. by a typical method after cold rolling.

If the annealing is performed at a temperature less than 760° C., non-recrystallized crystal grains exist in the steel sheet, causing an increase in yield strength while reducing the elongation and the r-value.

On the other hand, if annealing is performed at a temperature above 790° C., the formability can be enhanced. However, since the steel sheet has a grain size less than ASTM No. 9, which is the target ASTM grain size of the present invention, the steel sheet has an AI of 30 MPa or less, and is thus deteriorated in aging resistance.

For the steel sheet subjected to the low temperature coiling at the temperature of 500~550° C., the cold rolled steel sheet is annealed at a temperature of 770~830° C., where recrystallization of the steel sheet is completed and sufficient grain growth of ferrite crystal grains can occur.

Then, for the purpose of improving the aging resistance at room temperature along with the suitable bake hardenability in the bake hardenable cold-rolled steel sheet produced by the above processes, the cold-rolled steel sheet is subjected to temper rolling at a reduction ratio of 1.2~1.5%, which is somewhat higher than a typical temper rolling reduction ratio.

The reason of such a somewhat higher reduction ratio of 1.2 or more is to prevent the aging resistance from being deteriorated due to the solute carbon in the steel.

However, if the reduction ratio of the temper rolling is set to an excessively high value exceeding 1.5%, work hardening occurs and deteriorates the properties of the steel sheet despite improved aging resistance. In particular, when manufacturing a galvannealed steel sheet using the bake hardenable cold-rolled steel sheet of the invention, excessive temper rolling results in deterioration in plating adhesion, thereby causing separation of a plated layer. Thus, the temper rolling is preferably performed at the reduction ratio of 1.2~1.5% to solve the above problems.

The invention will be described in detail with reference to examples.

Example 1

After hot rolling steel slabs having compositions as shown in Table 1 to form hot rolled steel sheets, the hot rolled steel sheets were subjected to hot coiling, cold rolling, and continuous annealing according to conditions as shown in Table 2. Then, the annealed cold-rolled steel sheets were subjected to galvannealing at a temperature of 450° C., followed by temper rolling at a temper rolling reduction ratio of about 1.5%. Next, BH value, aging index (AI), grain size, and ductility brittleness transition temperature (DBTT) at a drawing ratio of 2.0 for evaluation of secondary work embrittlement were measured with respect to final steel sheets, the results of which are shown in Table 2.

Figure 6:
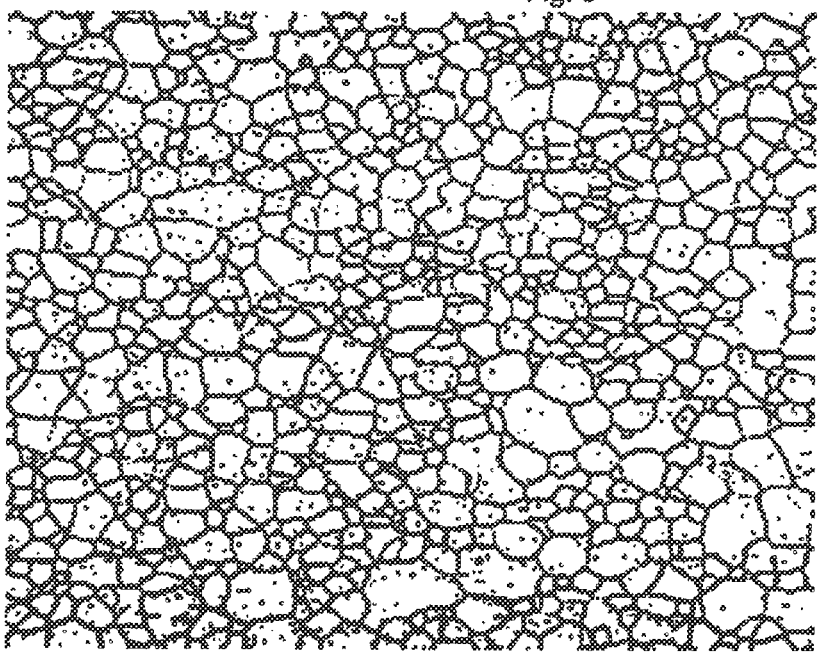
FIG. 6 is a micrograph showing microstructures of steel according to the present invention after annealing.

In addition, the microstructure of Inventive Steel No. 4 was observed with a microscope at a magnification of 200 after annealing, the results of which are shown in FIG. 6.

Figure 7:
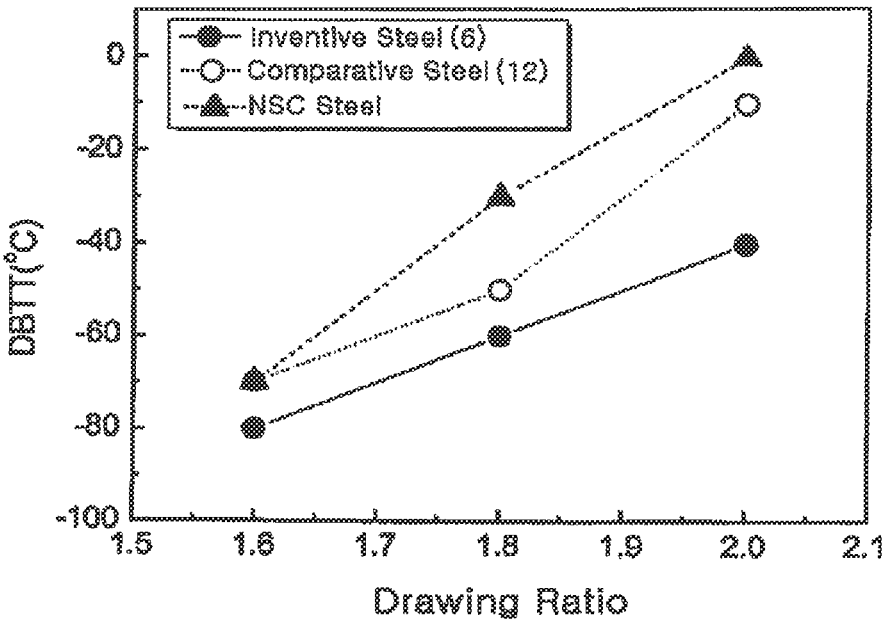
FIG. 7 is a graph describing influence of a drawing ratio on secondary work embrittlement.

In addition, Inventive Steel No. 6, Comparative Steel No. 12, and 0.0019C-0.63Mn-0.056P-0.03Sol.Al-0.005Ti-0.006Nb-0.0014N based steel (available from NSC) were observed in terms of change in DBTT according to change in drawing ratio, the results of which are shown in FIG. 7.

TABLE 1

| Steel | Composition (wt. %) | | | | | | | | | | Remark |
|---|---|---|---|---|---|---|---|---|---|---|---|
| | C | Mn | P | S | Sol. Al | Ti | Nb | N | Mo | B | |
| 1 | 0.0025 | 0.58 | 0.060 | 0.0082 | 0.087 | 0.009 | — | 0.0022 | 0.134 | 0.0005 | IS |
| 2 | 0.0027 | 0.25 | 0.068 | 0.0081 | 0.098 | 0.014 | — | 0.0017 | 0.148 | 0.0005 | IS |
| 3 | 0.0033 | 0.35 | 0.058 | 0.0058 | 0.105 | 0.015 | — | 0.0019 | 0.162 | 0.0007 | IS |
| 4 | 0.0029 | 0.61 | 0.071 | 0.0083 | 0.118 | 0.013 | — | 0.0015 | 0.159 | 0.0005 | IS |
| 5 | 0.0030 | 0.98 | 0.091 | 0.0057 | 0.104 | 0.010 | — | 0.0013 | 1.188 | 0.0007 | IS |
| 6 | 0.0029 | 1.11 | 0.10 | 0.0073 | 0.089 | 0.011 | — | 0.0021 | 0.162 | 0.0009 | IS |
| 7 | 0.0064 | 0.64 | 0.069 | 0.0071 | 0.082 | 0.001 | — | 0.0017 | 0.121 | 0.0007 | CS |
| 8 | 0.0022 | 0.63 | 0.066 | 0.0085 | 0.040 | 0.025 | — | 0.0015 | 0.115 | 0.0005 | CS |
| 9 | 0.0012 | 0.65 | 0.070 | 0.0072 | 0.095 | 0.011 | — | 0.0019 | 0.159 | 0.0008 | CS |
| 10 | 0.0021 | 0.93 | 0.096 | 0.0089 | 0.043 | 0.010 | 0.022 | 0.0017 | 0.121 | 0.0006 | CS |
| 11 | 0.0022 | 0.59 | 0.062 | 0.0066 | 0.071 | 0.012 | — | 0.0022 | 0.034 | 0 | CS |
| 12 | 0.0029 | 0.99 | 0.099 | 0.0078 | 0.041 | 0.017 | — | 0.0021 | 0 | 0.0007 | CS |
| 13 | 0.0030 | 0.62 | 0.047 | 0.0085 | 0.021 | 0 | — | 0.0019 | 0 | 0 | CS |
| 14 | 0.0023 | 0.98 | 0.120 | 0.0078 | 0.098 | 0.014 | — | 0.0023 | 0.031 | 0 | CS |

TABLE 2

| Steel | Coiling Temp. (° C.) | Cold Rolling Reduction Ratio (%) | Annealing Temp. (° C.) | BH (MPa) | AI (MPa) | ASTM No. | DBTT Temp. (° C.) | Remark |
|---|---|---|---|---|---|---|---|---|
| 1 | 620 | 78 | 780 | 47.4 | 23.4 | 9.7 | −40 | IS |
| 2 | 620 | 77 | 790 | 43.7 | 19.6 | 9.9 | −50 | IS |
| 3 | 620 | 78 | 775 | 43.2 | 17.4 | 10.1 | −50 | IS |
| 4 | 610 | 76 | 790 | 45.8 | 18.6 | 9.5 | −40 | IS |
| 5 | 620 | 78 | 790 | 47.6 | 16.3 | 10.3 | −40 | IS |
| 6 | 620 | 78 | 790 | 45.8 | 19.1 | 11.1 | −40 | IS |
| 7 | 620 | 78 | 780 | 68.0 | 55.2 | 10.2 | −50 | CS |
| 8 | 640 | 78 | 770 | 25.8 | 21.1 | 8.2 | 10 | CS |
| 9 | 620 | 78 | 790 | 0 | 0 | 8.1 | 20 | CS |
| 10 | 630 | 76 | 790 | 0 | 0 | 9.1 | 20 | CS |
| 11 | 620 | 78 | 780 | 43.8 | 34.6 | 10.9 | 0 | CS |
| 12 | 630 | 77 | 790 | 35.0 | 36.8 | 9.2 | −20 | CS |
| 13 | 620 | 76 | 790 | 44.1 | 22.8 | 9.5 | −10 | CS |
| 14 | 640 | 78 | 790 | 43.7 | 20.6 | 9.8 | 0 | CS |

As can be seen from Table 2, Inventive Steels of Nos. 1 to 6 were produced by strictly controlling the contents of C, Ti, Sol. Al and Mo to satisfy the condition of C: 0.0025~0.0033%, Mn: 0.25~1.11%, P: 0.058~0.10%, S: 0.0057~0.0083%, Soluble Al: 0.087~0.118%, N: 0.0013~0.0022%, Ti: 0.01~0.015%, Mo: 0.134~0.188% and B: 0.0005~0.0009%, and had a grain size of ASTM No. of 9.5~11.1 (that is, mean grain size of 7.7~13.4 μm). That is, Inventive Steels of Nos. 1 to 6 satisfied the condition of the present invention in terms of grain size, which is ASTM No. of 9 or more.

Meanwhile, as can be seen from FIG. 6, Inventive Steel No. 4 had very fine crystal grains which were very uniformly distributed over the entire cross section thereof.

As can be seen from Table 2, Inventive Steels of Nos. 1 to 6 had fine crystal grains. In this regard, since the inventive steels had higher Al contents than a typical Al content, fine AlN precipitates were formed in the steel and obstructed grain growth upon recrystallization annealing in combination with NbC precipitates. Thus, due to such a grain refining effect, the inventive steels had BH value of 43.2~47.6 MPa, and AI of 16.3~23.4 MPa, which indicated aging resistance at room temperature. With these results, it could be found that the inventive steels had excellent balance between the bake hardenability and the aging resistance at room temperature.

The inventive steels had a relatively low AI in comparison with a relatively high bake hardening degree. It was considered that this phenomenon was based on a retarding effect of solute carbon in the steel through addition of Mo along with the grain refining effect by the AlN precipitates.

Furthermore, as can be seen from FIG. 7, Inventive Steel No. 6 had an excellent DBTT due to an increase in coupling force between grain boundaries by addition of Mo in comparison with Comparative Steel No. 12 and the NSC-based steel.

Comparative Steel No. 7 has 0.0064% of C, which was higher than the carbon content of the present invention in the range of 0.0025~0.0035%, but satisfied the conditions of the present invention in terms of high coiling temperature and annealing temperature.

Comparative Steel No. 7 had a very fine recrystallized grain size of ASTM No. 10.2. However, since it was very high in carbon content, Comparative Steel No. 7 was excellent in DBTT due to an increase in amount of the solute carbon in the steel, but it also had the very high BH and an AI of 30 MPa or more, which indicated a significantly low aging resistance.

Comparative Steel No. 8 comprised 0.04% of Sol. Al which was lower than the Sol. Al content of the present invention in the range of 0.08~0.12%, and 0.25% of Ti which was higher than the range of the invention.

Thus, it could not be expected for Comparative Steel No. 8 to have improvement in the grain refining effect and BH value by means of the AlN precipitates. Furthermore, since the high added amount of Ti caused all carbon in the steel to be precipitated into TiC, and thus such reduction in amount of solute carbon caused reduction of site competition effect with P, the steel exhibited negligible bake hardenability, and was deteriorated in DBTT.

Comparative Steel No. 9 satisfied the composition of the present invention except that it comprised 0.0012% of carbon, which was lower than that of the present invention.

Thus, it could be found that Comparative Steel No. 9 had coarsened grains and did not exhibit the bake hardenability and aging resistance due to the low carbon content. In addition, Comparative Steel No. 9 had a DBTT of 20° C., which was a significantly deteriorated value Comparative Steel No. 10 did not satisfy the composition of the present invention in view of Sol. Al, and comprised Nb.

Specifically, since Comparative Steel No. 10 comprised 0.043% of Sol. Al, which was lower than the Al content of the present invention, it could not be expected to improve the grain refining effect and BH value by means of the AlN precipitates. In addition, Comparative Steel No. 10 also comprised 0.022% of Nb, which was higher than Nb content of the present invention. Thus, although the steel had a small grain size of ASTM No. 9.1, such a high Nb content caused excessive precipitation of NbC, causing lack of solute carbon in the steel. As a result, the steel barely exhibited the bake hardenability and was noticeably deteriorated in the DBTT.

Comparative Steel No. 11 had a lower Mo content than that of the present invention, and did not comprise B at all Comparative Steel No. 11 had an aging index of 30 MPa or more, and, was significantly deteriorated in DBTT due to non addition of Mo and B.

Comparative Steel No. 12 had a lower Sol. Al content than that of the present invention, and did not comprise Mo at all. Thus, the steel was deteriorated in aging resistance and DBTT due to reduction in coupling force between the grain boundaries resulting from non addition of Mo compared with the high P content.

Comparative Steel No. 13 had an insufficient amount of Sol. Al and did not comprise Ti, Mo and B at all Due to lack of Sol. Al and Ti, it could not be expected to have further improved grain refining effect and bake hardenability. Furthermore, the steel was deteriorated in DBTT due to non addition of Mo and B.

Comparative Steel No. 14 comprised 0.12% of P, which exceeded the P content of the present invention in the range of 0.05~0.11%, and did not comprise B. If Comparative Steel No. 14 could be improved in the DBTT due to addition of Mo, there was a restriction in improvement thereof due to the high content of P. Furthermore, since Comparative Steel No. 14 did not comprise B at all, the effect of improving the DBTT was eliminated, and thus the steel had a DBTT of 0° C.

Example 2

After hot rolling steel slabs having compositions as shown in Table 3 to form hot rolled steel sheets, the hot rolled steel sheets were subjected to coiling, cold rolling, and continuous annealing according to conditions as shown in Table 4. Then, the annealed cold-rolled steel sheets were subjected to galvannealing at a temperature of 450° C., followed by temper rolling at a temper rolling reduction ratio of about 1.5%. Next BH value, aging index (Al), and grain sizes were measured with respect to 3 final steel sheets. Results thereof are shown in Table 4.

Table 3 shows the compositions of inventive steel sheets and comparative steel sheets wherein the inventive steel sheets were produced by strictly controlling amounts of C, Ti, Sol. Al and Mo. In Table 3, Steel Nos. 15~30 indicate the inventive steels, and Steel Nos. 21~26 indicate Comparative Steels.

Table 4 shows the manufacturing conditions and properties of steel using steel slabs which have the compositions as shown in Table 3. After hot rolling the steel slabs in a low temperature coiling condition and a high temperature coiling condition to form hot rolled steel sheets, the steel sheets were subjected to cold rolling at cold rolling reduction ratios of 75~78%, continuous annealing at temperatures of 775~790° C., galvannealing at a temperature of 450° C., and temper rolling at a temper rolling reduction ratio of about 1.5%. Then, the BH value, AI value, and grain size of the steel sheets were measured, the results of which are shown in Table 4.

In Table 4, the low temperature coiling was performed at temperatures of 520~540° C., and the high temperature coiling was performed at temperatures of 630~700° C.,

TABLE 3

| | Composition (wt. %) | | | | | | | | | | |
|---|---|---|---|---|---|---|---|---|---|---|---|
| Steel | C | Mn | P | S | Sol. Al | Ti | Nb | N | Mo | B | Remark |
| 15 | 0.0017 | 0.58 | 0.060 | 0.0082 | 0.087 | 0.009 | — | 0.0022 | 0.134 | 0.0005 | IS |
| 16 | 0.0024 | 0.35 | 0.068 | 0.0081 | 0.098 | 0.014 | — | 0.0017 | 0.140 | 0.0005 | IS |
| 17 | 0.0020 | 0.35 | 0.058 | 0.0058 | 0.105 | 0.015 | — | 0.0020 | 0.172 | 0.0007 | IS |
| 18 | 0.0019 | 0.61 | 0.071 | 0.0083 | 0.108 | 0.013 | — | 0.0015 | 0.169 | 0.0006 | IS |
| 19 | 0.0020 | 0.98 | 0.081 | 0.0057 | 0.104 | 0.010 | — | 0.0013 | 0.178 | 0.0007 | IS |
| 20 | 0.0023 | 1.15 | 0.105 | 0.0073 | 0.119 | 0.011 | — | 0.0021 | 0.152 | 0.0008 | IS |
| 21 | 0.0064 | 0.64 | 0.069 | 0.0071 | 0.082 | 0.001 | — | 0.0017 | 0.121 | 0.0007 | CS |
| 22 | 0.0022 | 0.63 | 0.066 | 0.0085 | 0.090 | 0.025 | — | 0.0015 | 0.115 | 0.0005 | CS |
| 23 | 0.0012 | 0.65 | 0.070 | 0.0072 | 0.095 | 0.011 | — | 0.0019 | 0.159 | 0.0008 | CS |
| 24 | 0.0022 | 0.93 | 0.096 | 0.0089 | 0.033 | 0.010 | 0.22 | 0.0017 | 0.121 | 0.0006 | CS |
| 25 | 0.0021 | 0.59 | 0.062 | 0.0066 | 0.081 | 0.012 | — | 0.0022 | 0.034 | — | CS |
| 26 | 0.0019 | 0.99 | 0.099 | 0.0078 | 0.041 | 0.017 | — | 0.0021 | 0 | 0.0007 | CS |

TABLE 4

| Steel | Coiling Temp. (° C.) | Cold rolling Reduction Rate (%) | Annealing Temp. (° C.) | BH (MPa) | AI (MPa) | ASTM No. | Sample No. |
|---|---|---|---|---|---|---|---|
| IS 15 | 520 | 78 | 780 | 47.4 | 23.4 | 9.7 | I-S 15 |
| | 630 | 78 | 780 | 27.9 | 12.3 | 8.8 | C-S 15 |

TABLE 4-continued

| Steel | Coiling Temp. (° C.) | Cold rolling Reduction Rate (%) | Annealing Temp. (° C.) | BH (MPa) | AI (MPa) | ASTM No. | Sample No. |
|---|---|---|---|---|---|---|---|
| IS 16 | 520 | 77 | 790 | 43.7 | 19.6 | 9.9 | I-S 16 |
| | 700 | 77 | 790 | 28.1 | 12.9 | 9.3 | C-S 16 |
| IS 17 | 540 | 78 | 770 | 43.2 | 17.4 | 9.9 | I-S 17 |
| | 680 | 78 | 770 | 23.5 | 13.1 | 8.9 | C-S 17 |
| IS 18 | 540 | 76 | 790 | 45.8 | 18.6 | 9.5 | I-S 18 |
| | 680 | 76 | 790 | 24.1 | 11.3 | 8.2 | C-S 18 |
| IS 19 | 520 | 78 | 790 | 47.6 | 16.3 | 103 | I-S 19 |
| | 650 | 78 | 790 | 27.3 | 10.5 | 9.5 | C-S 19 |
| IS 20 | 540 | 78 | 790 | 45.8 | 19.1 | 11.1 | I-S 20 |
| | 700 | 78 | 790 | 28.4 | 14.5 | 9.2 | C-S 20 |
| CS 21 | 540 | 78 | 780 | 78.0 | 58.2 | 10.2 | C-S 21 |
| | 700 | 78 | 780 | 65.2 | 48.1 | 9.9 | C-S 22 |
| CS 22 | 540 | 78 | 770 | 25.8 | 21.1 | 9.2 | C-S 23 |
| | 700 | 78 | 770 | 5.5 | 2.9 | 8.0 | C-S 24 |
| CS 23 | 520 | 78 | 790 | 0 | 0 | 8.1 | C-S 25 |
| | 700 | 78 | 790 | 0 | 0 | 7.9 | C-S 26 |
| CS 24 | 530 | 76 | 790 | 0 | 0 | 9.9 | C-S 27 |
| | 700 | 76 | 790 | 0 | 0 | 9.3 | C-S 28 |
| CS 25 | 520 | 78 | 780 | 43.8 | 34.6 | 10.9 | C-S 29 |
| | 700 | 78 | 780 | 24.8 | 20.8 | 9.4 | C-S 30 |
| CS 26 | 530 | 77 | 790 | 35.0 | 36.8 | 9.2 | C-S 31 |
| | 700 | 77 | 790 | 22.0 | 17.1 | 8.8 | C-S 32 |

As can be seen from Table 4, Inventive Samples of Nos, 15~20 produced according to the compositions and manufacturing conditions of the invention had grain sizes of ASTM No of 9.5~11.1 (average grain sizes of 7.7~14.3 μm), which met the requirement of the invention in view of grain size. Such fine crystal grains of Inventive Samples of Nos. 15~20 as shown in Table 4 were caused by suppression of, grain growth upon recrystallization annealing by fine AlN precipitates related to a higher added amount of Al than a typical level and by solute carbon related to non precipitation of TiC.

Thus, due to such a grain refining effect and control of amounts of solute carbon in the steel, inventive samples had bake hardening degrees of 43.2~47.6 MPa, and AIs of 16.3~3.4 MPa, as a value of indicating the aging resistance at room temperature. From these results, it could be found that Inventive Samples had excellent balance between the bake hardenability and the aging resistance at room temperature.

As can be seen from Table 4, Inventive Samples of Nos. 15~20 had lower AI value n comparison with high BH value. It is considered that such lower AI were caused by retarding effect of the solute carbon in the steel by addition of Mo in combination of the grain refining effect by the AlN precipitates.

Comparative Samples of Nos 15~20 were produced by high temperature coiling at temperatures of 630~700° C. with the use of Inventive Steels of Nos, 15~20. These comparative samples had much lower BH value than the target value of the present invention due to reduction in amount of solute carbon in the steel via precipitation of TiC. In particular, it could be found that the Comparative Samples of Nos. 15, 17 and 18 did not meet the requirement for the grain size of the present invention which is ASTM No. of 9 or more.

With these results, it could be understood that the grain size of the steel was largely influenced by the solute carbon in the steel as well as the AlN precipitates.

Comparative Sample No. 21 had a higher content of carbon than that of the present invention. Such a higher content of carbon suppressed the precipitation of TiC upon low temperature coiling, allowing a greater amount of solute carbon to reside in the steel. Thus, the sample had a very high BH and AI.

Comparative Steel No. 21 had a very fine grain size of ASTM No. 10.2 due to an increase in amount of solute carbon.

Comparative Sample No. 22 was produced through high temperature coiling. Although this sample was somewhat decreased in BH due to precipitation of TiC in the steel, providing BH and AI noticeably exceeding the target values of the present invention due to the very high added amount of carbon.

Comparative Sample No. 23 had 0.025% of Ti, which was higher than the Ti content of the present invention. Thus, although Comparative Sample No. 23 was subjected to the low temperature coiling, such an excessive amount of Ti caused some of the carbon content to be precipitated into TiC, thereby providing the bake hardenability to the steel. However, this sample had a lower BH value less than 30 MPa as the target value of the present invention.

Comparative Sample No. 24 was also produced through high temperature coiling. For this steel, the precipitation of TiC was more actively progressed due to addition of Ti than for the low temperature coiled steel, thereby providing a low BH.

Comparative Samples of Nos. 25 and 26 satisfied the compositions of the present invention except for the carbon content of 0.0012%, which was lower than the carbon content of the present invention.

Even with the low temperature coiling, these comparative samples failed to have solute carbon in the steel, and had coarsened crystal grains due to the low carbon content. In addition, these comparative samples had no bake hardenability and aging resistance.

Comparative Samples of Nos. 27 and 28 had Sol. Al content deviating from the composition of the invention, and comprised an excessive Nb content of 0.022%. That is, since the Comparative Samples of Nos. 27 and 28 had 0.043% of Sol. Al, it could not be expected to have the grain refining effect and the improvement in BH through addition of Al. Furthermore, since these samples had the excessive Nb content of 0.022%, amounts of NbC precipitates were excessively increased. As a result, although these comparative samples had a grain size of ASTM No. 9.1 and met the requirement of the present invention in terms of grain size, these comparative samples completely failed to obtain the BH due to lack of solute carbon in the steel resulting from excessive precipitation of NbC.

Comparative Samples of Nos. 29 and 30 had a lower Mo content than that of the present invention, and did not comprise B at all. Even with the low temperature coiling, the Comparative Samples of Nos. 29 and 30 had an aging index of 30 MPa or more, and were significantly deteriorated in DBTT due to non addition of Mo and B.

Comparative Samples of Nos. 31 and 32 had a lower Sol. Al content than that of the invention, and did not comprise Mo at all. Thus, these samples were deteriorated in aging resistance and DBTT due to reduction in coupling force between the grain boundaries resulting from non addition of Mo compared with the high P content.

Industrial Applicability

As apparent from the above description, according to the present invention, the cold-rolled steel sheet and the galvannealed steel sheet produced using the same have excellent bake hardenability, aging resistance at room temperature, and secondary work embrittlement resistance.

In addition, according to the present invention, the bake hardenable high strength cold-rolled steel sheet and the galvannealed steel sheet produced using the same have excellent bake hardenability, aging resistance at room temperature, and a tensile strength at the level of 340~390 MPa.

What is claimed is the following:

1. A high strength cold-rolled steel sheet with superior bake hardenability, comprising, by weight %:

C: 0.0016~0.0025%; Si: 0.02% or less; Mn: 0.2~1.2%; P: 0.05~0.11%; S: 0.01% or less; Sol. Al: 0.08~0.12%; N: 0.0025% or less; Ti: 0.008~0.018%; Mo: 0.1~0.2%; B: 0.0005~0.0015%; and the balance of Fe and other unavoidable impurities, wherein the steel sheet is Nb-free and satisfies Equations 1 and 2:

$$Ti^*[\text{Effective Ti}]=\text{Total Ti}-(48/14)N-(48/32)S\leqq 0 \quad (1)$$

C*[amount of solute carbon in grain boundaries (GB-C)+amount of solute carbon in crystal grains (G-C)]=Total C (ppm)−C in TiC=8~15 ppm - - - (2)[in Equation 2, GB-C (that is, the amount of solute carbon in the grain boundaries) is 5~10 ppm, and G-C (that is, the amount of solute carbon in the crystal grains) is 3~7 ppm], and wherein the steel sheet has ASTM No. of 9 or more, a bake hardenability value (BH) of 30 MPa or more, an aging index (AI) of 30 MPa or less, and a tensile strength of 340~390 MPa.

2. A galvannealed steel sheet with superior bake hardenability, comprising, by weight %:

C: 0.0016~0.0025%; Si: 0.02% or less; Mn: 0.2~1.2%; P: 0.05~0.11%; S: 0.01% or less; Sol. Al: 0.08~0.12%; N: 0.0025% or less; Ti: 0.008~0.018%; Mo: 0.1~0.2%; B: 0.0005~0.0015%; and the balance of Fe and other unavoidable impurities, wherein the steel sheet is Nb-free and satisfies Equations 1 and 2:

$$Ti^*[\text{Effective Ti}]=\text{Total Ti}-(48/14)N-(48/32)S\leqq 0 \quad (1)$$

C*[amount of solute carbon in grain boundaries (GB-C)+amount of solute carbon in crystal grains (G-C)]=Total C (ppm)−C in TiC=8~15 ppm - - - (2)[in Equation 2, GB-C (that is, the amount of solute carbon in the grain boundaries) is 5~10 ppm, and G-C (that is, the amount of solute carbon in the crystal grains) is 3~7 ppm], and wherein the steel sheet has ASTM No. of 9 or more, a bake hardenability value (BH) of 30 MPa or more, an aging index (AI) of 30 MPa or less, and a tensile strength of 340~390 MPa.

3. A method for manufacturing a high strength cold-rolled steel sheet with superior bake hardenability, comprising:

performing homogenization heat treatment for an Al-killed steel slab at 1,200° C. or more, the steel slab comprising, by weight %: C: 0.0016~0.0025%; Si: 0.02% or less; Mn: 0.2~1.2%; P: 0.05~0.11%; S: 0.01% or less; Sol. Al: 0.08~0.12%; N: 0.0025% or less; Ti: 0.008~0.018%; Mo: 0.1~0.2%; B: 0.0005~0.0015%; and the balance of Fe and other unavoidable impurities, wherein the steel sheet is Nb-free and satisfies the Equation 1 (Ti*[Effective Ti]=Total Ti−(48/14)N−(48/32)S≦0 - - - (1);

hot rolling the steel slab with finish rolling at a finish rolling temperature of 900~950° C. to form. a hot-rolled steel sheet, followed by coiling the hot-rolled steel sheet at a temperature of 500~550° C.;

cold rolling the hot-rolled steel sheet at a reduction ratio of 75~80%;

continuously annealing the cold rolled steel sheet at a temperature of 770~830° C.; and temper rolling the annealed steel sheet at a reduction ratio of 1.2~1.5%.

* * * * *